United States Patent [19]

Hebrank

[11] Patent Number: 4,793,974

[45] Date of Patent: Dec. 27, 1988

[54] FUME INCINERATOR WITH REGENERATIVE HEAT RECOVERY

[76] Inventor: William H. Hebrank, 14 Hermitage Rd., Greenville, S.C. 29615

[21] Appl. No.: 23,771

[22] Filed: Mar. 9, 1987

[51] Int. Cl.[4] ..... F23B 5/04; F23G 7/06

[52] U.S. Cl. ..... 422/175; 422/206; 110/211; 110/304; 165/4; 165/7; 431/5

[58] Field of Search ..... 422/171, 172, 175, 182, 422/206; 110/210, 211, 216, 302, 304; 431/5, 7; 55/18, 273, 283, 284, 287; 165/4, 7

[56] References Cited

U.S. PATENT DOCUMENTS

| | | | |
|---|---|---|---|
| 2,735,510 | 2/1956 | Dooley | 55/273 |
| 3,411,929 | 11/1968 | Garrett | 55/273 |
| 4,021,211 | 5/1977 | Turek | 55/18 |
| 4,227,375 | 10/1980 | Tompkins et al. | 165/4 |
| 4,252,070 | 2/1981 | Benedick | 422/175 |
| 4,384,546 | 5/1983 | Stahl | 55/273 |
| 4,424,857 | 1/1984 | Linde | 165/7 |
| 4,454,826 | 6/1984 | Benedick | 422/175 |
| 4,474,118 | 10/1984 | Benedick | 422/175 |
| 4,650,414 | 3/1987 | Grenfell | 422/175 |

FOREIGN PATENT DOCUMENTS

| | | | |
|---|---|---|---|
| 708303 | 1/1980 | U.S.S.R. | 165/7 |
| 836626 | 6/1981 | U.S.S.R. | 165/4 |

*Primary Examiner*—Michael S. Marcus
*Assistant Examiner*—Jill Johnston
*Attorney, Agent, or Firm*—Cort Flint

[57] ABSTRACT

This invention relates to a regenerating, hazardous waste gas fume and odor incinerator. The incinerator comprises a combustion chamber (12) and at least three heat exchanger regenerator beds (26, 28, 30) through which the waste gases pass selectively for preheating on their way to the combustion chamber and the processed, heated gases are passed through for cooling before exhausted. All three regenerator beds are cycled from a cooling position in which they absorb heat from the previously processed gases to a second position where they preheat waste gases en route to the combustion chamber to an inactive position where they do not receive gases either from the waste supply or from the combustion chamber. The waste gases, after being preheated, are directed to the combustion chamber through a plenum chamber (14) in which is located a combustion burner (16). The preheated waste gases are directed through the flame of the burner into the combustion chamber for ignition and for combustion therein. The incinerator has a flow control valve system (37, 39, 41, 43) and a computer controller (80) for cycling the regenerator beds as noted herein.

13 Claims, 4 Drawing Sheets

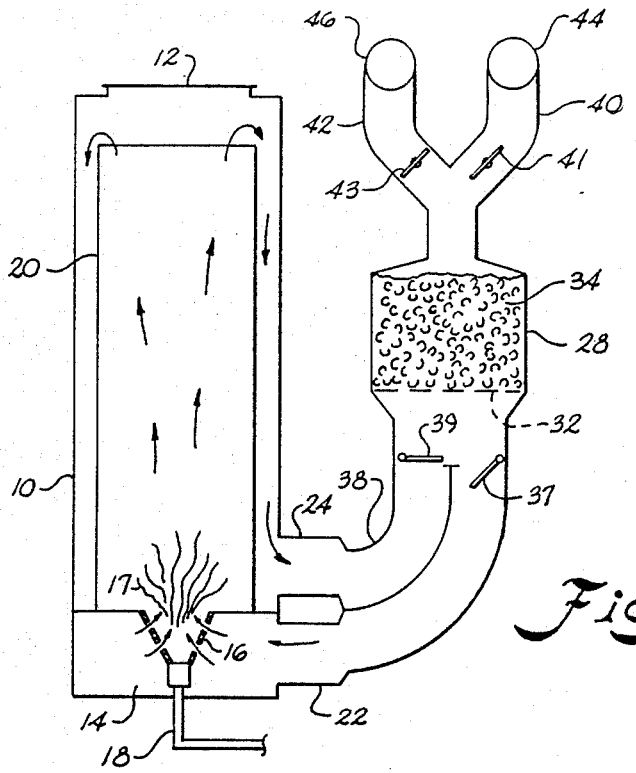
Fig. 3
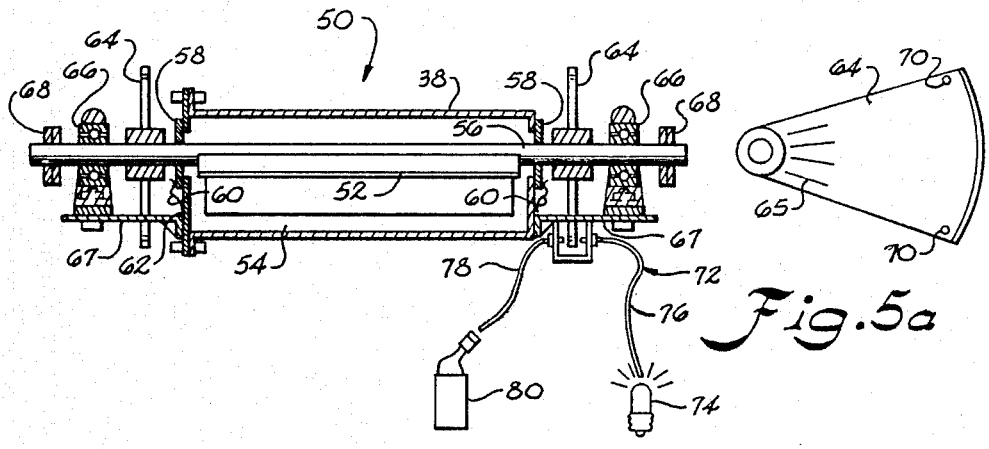
Fig. 5a
Fig. 5

FUME INCINERATOR WITH REGENERATIVE HEAT RECOVERY

BACKGROUND OF THE INVENTION

This invention relates to a regenerative type hazardous waste gas fume and odor incinerator that has a flow control valve system between the combustion chamber and the regenerator beds providing for continuous gas flow in one direction, passing through the gas or oil fed combustion burner.

Nearly all waste gas fume incinerators use heat recovery to obtain a high incinerator temperature with less fuel consumption. In general, heat recovery regenerators are more efficient than heat exchangers, and so are preferred for low fuel usage incinerator consumption.

This invention relates to a regenerative type incinerator used to control hazardous waste gas fumes and odors produced by industrial processes. In particular, the invention provides a new and novel construction of the regenerators to improve the ignition or burning of hazardous gases by control of the flow direction through the burner and the combustion zone.

Safety codes require inflammable industrial gas concentrations to be less than one fourth (¼) of the lower explosion limits, and so industrial process exhaust fumes have a relatively low concentration of combustible gases. These low concentrations are difficult to ignite. It is also hard to keep the purification process combustion going in ignited gases of low concentrations unless high temperatures are maintained until the chemical reactions are completed.

Prior art waste gas fume incinerator apparatus in general follows either one or the other of the following processes:

In the first process, waste gas fumes flow in the same direction continuously through the burner and the combustion chamber. A high temperature heat exchanger of tubular or plate type construction is included in the system to conserve fuel and to increase the incinerator temperature by preheating waste gas fumes before they reach the burner. This process ignites and incinerates waste gas fumes at the burner, in the burner flames, as preheated waste gas passes through the burner from the back of the burner to the front of the burner in the same direction all of the time. In flame fronts and burning flames, gases are at elevated temperatures and highly ionized. Preheated combustible gases flowing into the flames are readily ignited by the highly reactive flame fronts and purified by a half second retention time in the combustion chamber. After leaving the combustion chamber, purified gases enter the opposite side of the high temperature heat exchanger to recover some of the heat released by the burner to reduce the large amount of fuel used in this process.

In the second process, instead of the waste gas passing through burner flames for gas purification the gases are ignited and burned by raising them to very high temperatures, 1500 degrees or higher, and holding all of the gas at such temperatures for at least a half second retention time for the hazardous chemicals to reduce to harmless carbon dioxide and water. This process is called "thermal incineration". Effective thermal incineration apparatus can be designed with very large, expensive, high temperature, high efficiency heat exchangers. However, all practical systems use the regenerative type heat exchanging device. In state of the art regenerative type incinerators gas flow in the combustion chamber reverses direction and cannot be controlled to flow in one direction through the burner and burner flames for early ignition of impure and noxious chemicals. With lack of control in the combustion chamber, to achieve the shortest path retention time of a half second, the combustion chamber is sized for an average 1.8 (one and eight-tenths) second retention time which requires the combustion chamber volume to be inreased to 3.6 (three and six tenths) times in size. The system must use very high temperatures to ignite and burn chemicals and those high temperatures need expensive, high temperature materials for construction of the combustion chamber. The construction cost and the effectiveness of regenerative type incinerators could be improved if the waste gases are ignited as they enter the combustion chamber by passing them through the burner flames.

An example of the Thermal Incineration process is found in the apparatus disclosed in U.S. Pat. No. 3,895,918. In this patent, a thermal regeneration, antipollution system has a central, generally cylindrical, purification chamber which operates at a high temperature to oxidize, burn-off, or otherwise, thermally process undesired or noxious fumes or odors from industrial or other processes. The purification chamber is topped by a refractorily-lined dome and at its periphery there are a plurality of associated flue-heat-exchange bed combinations, bounded by vertical walls defining horizontal cross-sections in the general shape of a catenary curve. The heat exchange bed in this patent includes ceramic packing held towards the inner side of the heat exchange bed by angled louvers. A plurality of burners are provided for keeping the temperature in the purification chamber at between 1400 degrees and 1800 degrees Fahrenheit. As was pointed out above, the refractory-lined dome and other high temperature construction materials required by this device sized to accommodate the longer gas retention time makes the cost of such devices prohibitive.

SUMMARY OF THE INVENTION

This invention relates to a waste gas, regenerative type incinerator with a continuous gas flow always in the same direction through the incinerator's combustion chamber and the flame of the burner. This produces ionized reacting flames which ignite fumes, while still keeping the reversing gas flow direction needed in the regenerators.

It is an object of the present invention to provide an incinerator which has a continuous gas flow that still permits the reversing gas flow through the regenerators. With unidirectional flow in the combustion chamber, the chamber can be made smaller because it can be sized for half second retention time instead of one and eight tenths (1.8) second retention time. This is accomplished by the use of manifolds and new and novel check valve construction placed between the incinerator's regenerators and the combustion chamber.

It is another object of this invention to provide an incinerator with a reliable check valve system. The incinerator valves must function with reliability because incinerators often purify explosive waste gases and use heating fuels that are explosive. Furthermore, this check valve system is located in the highest temperature zones of the incinerator.

It is a further object of this invention to provide an improved incinerator that ignites waste gases as they are passed through burner flames in one direction and accomplishes additional purification by exposing the ignited gases to temperatures that are two to five hundred degrees lower than the temperatures normally required by thermal incinerators. This lower incinerator temperature and smaller combustion chamber size leads to considerable savings in the use of high temperature construction materials such as refractory linings, high temperature stainless steels, and so on.

BRIEF DESCRIPTION OF THE DRAWINGS

An incinerator designed to carry out the invention will hereinafter be described, together with other features thereof.

The invention will be more readily understood from a reading of the following specification, and by reference to the accompanying drawings forming a part thereof, wherein an example of the invention is shown, and wherein:

FIG. 3 is a sectional view taken along lines 3—3 of FIG. 1;

FIG. 5 is a side elevational cut-away view of the manifold check valve used in each of the manifolds;

FIG. 5A is a side view of a check valve segment;

DESCRIPTION OF A PREFERRED EMBODIMENT

Figure 1:
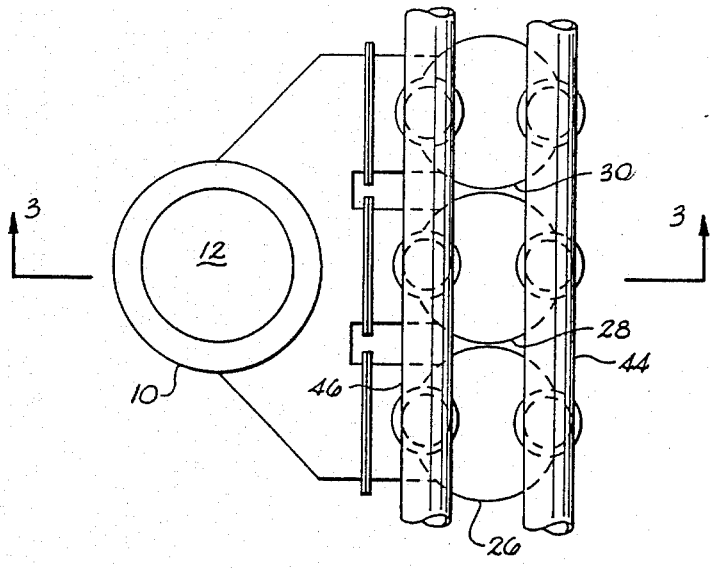
FIG. 1 is a top plan view of an incinerator constructed in accordance with the invention.
Figure 2:
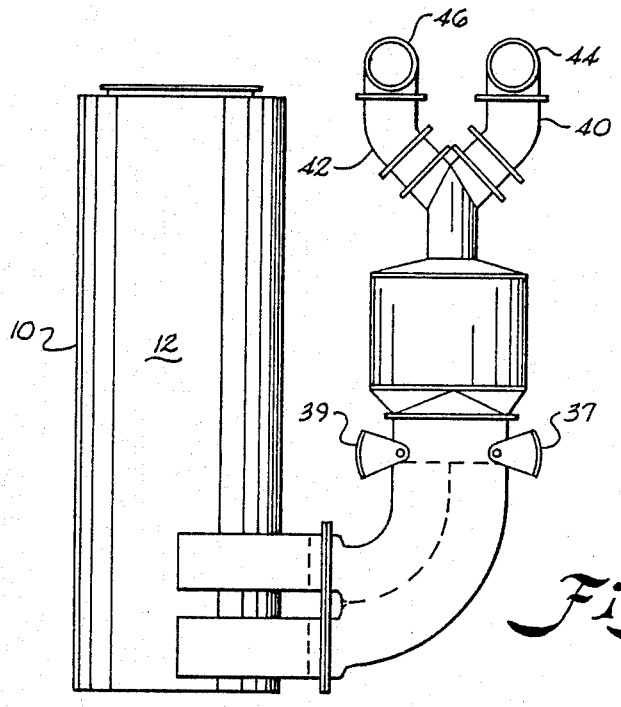
FIG. 2 is a front view of the incinerator illustrated in FIG. 1.

Referring now to FIGS. 1, 2, 3, 4, 5 and 5A, wherein a preferred embodiment of the invention is illustrated. A fume incinerator 10 comprises a combustion chamber 12 having a plenum chamber 14. Disposed within the plenum chamber 14 is a combustion burner 16 which is fed by an outside oil or gas source (not shown) such as butane or the like through gas line 18.

Burner 16 is disposed adjacent to a centrally disposed opening 17 in the bottom of the combustion chamber 12. Flames from burner 16 extend through opening 17 into the combustion chamber 12. Disposed within combustion chamber 12, centrally thereof, is a hollow, cylindrical baffle 20 which reaches near the top of combustion chamber 12 and surrounds opening 17. Connected to the plenum chamber 14 is an intake manifold 22 designed to feed incoming waste gases to burner 16 in a manner to be described hereinafter.

Preheated waste gases fed into plenum chamber 14 are ignited by the flames from burner 16 and purified gases resulting therefrom rise over baffle 20, designed to hold all gases for at least a half second retention time and exit from the combustion chamber through an exhaust manifold 24.

Waste gases to be processed by the incinerator are supplied to intake manifold 22 through one of the fixed bed regenerators 26, 28, or 30.

Each of the fixed bed regenerators comprises a generally cylindrical chamber with a grid work support 32 for a bed of heat storage elements 34. The heat storage elements 34 may comprise ceramic or metalic separating tower bed elements such as those commercially available from Koch Engineering Company.

Figure 4:
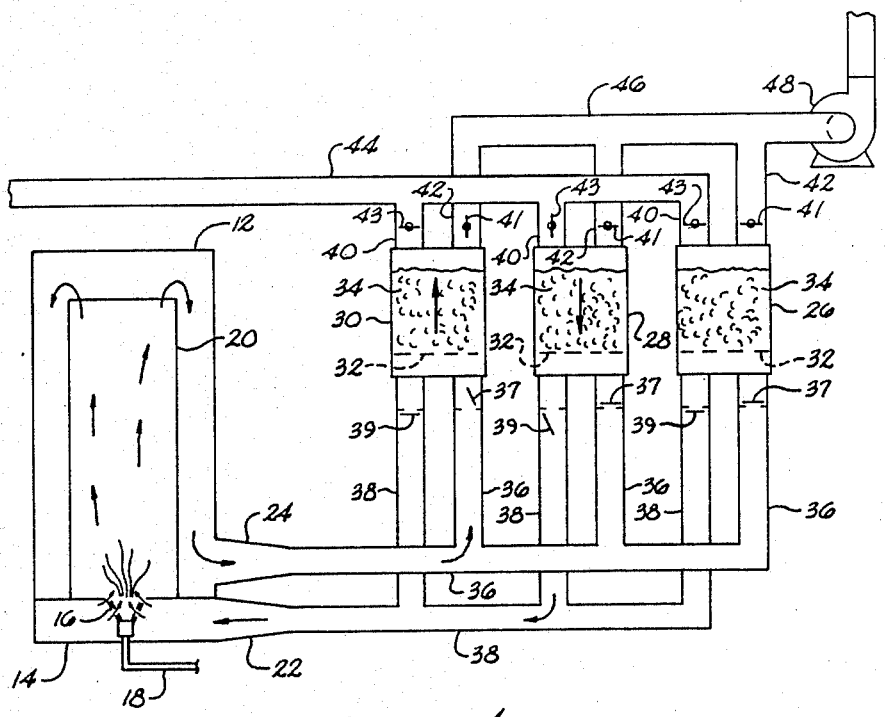
FIG. 4 is a schematic illustration of the incinerator illustrated in FIG. 1.

Waste gases or fumes to be purified or incinerated are supplied to the incinerator through a central supply line 44. Referring more particularly now to FIG. 4, it will be seen that the waste fumes are directed through regenerator 28. The fumes come from the central supply line 44, down through supply line 40 of regenerator 28 and through previously heated heat storage elements 34. These elements preheat the gas fumes and the gas fumes are then transported through intake duct 38 to the intake manifold 22. The waste fumes having been preheated by regenerator 28 are in a heated condition to be burned by the flames of burner 16 as they move through opening 17. The purified gases are then drawn upwardly in combustion chamber 12 over baffle 20 and are exhausted through exhaust manifold 24 and through exhaust duct 36 of regenerator 30 by exhaust fan 48. The purified gases are very hot and pass through the heat storage element bed 34 and transfer the heat from the gases to said heat storage elements. The purified gases then pass through exhaust line 42 of regenerator 30 into the central exhaust lines 46 and through exhaust fan 48 and then to the atmosphere.

As seen in FIG. 4, in regenerator 26, valves 41, 43, 39, and 37 are closed and regenerator 26 is thus momentarily, i.e. 0.75 seconds, inactive before reversing from its prior condition. Periodically, the gas flow is cycled so that regenerator 30 has its valves 41 and 43 reversed and 39 and 37 reversed so that the supply of fumes will be directed through heat exchange elements 34. When regenerator 30 is cycled to supply the waste fumes to the combustion chamber, regenerator 28 then becomes momentarily, i.e. 0.75 seconds, inactive to reverse its flow and regenerator 26 becomes active to permit the exhaust of the heated, purified gases through regenerator 26. In this manner, there is always a supply of waste gases in fumes going through a preheated heat storage bed regenerator to burner 16 and always a supply of purified heated gases preheating the heat exchange elements of the next regenerator in preparation for its being cycled in turn to preheat the waste gases. In this manner, all of the waste fumes are preheated prior to being directed into the flames of burner 16. All of the purified gases are cooled by passage through a previously inactive regenerator so as to prepare its heat exchange elements for the next stage in the process. Check valves 37 and 39 are designed to operate when flow pressure changes by action of valves 43 and 41, and control the flow of the waste gases through the gas burner. The flow is controlled so that the waste gas fumes flow through the burner in one direction only from below the burner outwardly across the ionized reacting flame for rapid ignition and combustion. The waste gases go down through a preheated, thermal storage unit and thence through the gas burner. This pattern of separate reversing of the regenerator flow in a controlled, sequential manner reverses the regenerator flow without stopping the inlet and outlet flow to and from the combustion chamber.

This is very important since the industrial waste gas fumes and others are pulled into the incinerator system by reduced pressure in the intake manifold 22. These gases are pulled all of the way through the system by exhaust fan 48 at the exit end of the system. Low pressure in the combustion chamber pulls closed and holds closed check valve 37 while at the same time pulling open and holding open check valve 39 in regenerator 28 so that fumes from regenerator 28 pass through intake duct 38 into intake manifold 22.

Figure 7:
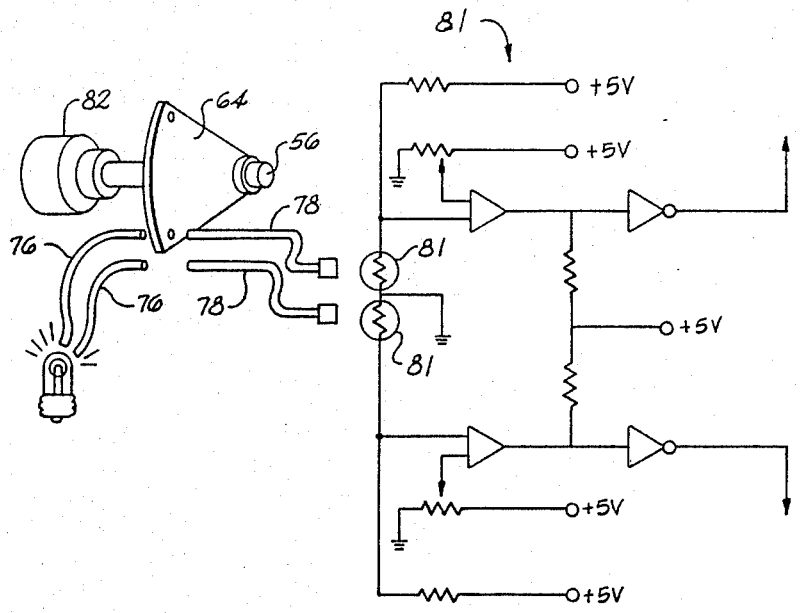
FIG. 7 is a schematic illustration of the check valve position indicating segment with fiber optics and a photoelectric wiring diagram.

Referring now to FIGS. 5, 5A, and 7, wherein is illustrated a check valve and its position detection mechanism such as are used on valves 37 and 39 noted above. In FIGS. 5 and 5A check valve 50 comprise a check valve plate 52 and a valve seat 54. Check valve plate 52 is supported by a check valve shaft 56 which extends through the housing of the duct in which the valve is located. As seen in FIG. 5, this is duct 38. Shaft 56 is gas sealed by asbestos seals 58 which are held in place by seal springs 60.

At one end of the duct is a removable hatch 62 to facilitate removal and placement of the check valve plate 52. The check valve shaft 56 is supported at either end by bearings 66 and held in place by shaft retainers 68. Mounted on each end of the shaft 56 are two segments 64 which revolve with the shaft. Each of these segments 64 are provided with a series of cooling fins 65 to assist in dissipating the heat absorbed by shaft 56 during the operation of the incinerator. One of the segments 64 is provided with two holes 70 and 71, each of which are in different positions in the segment. Each bearing 66 is supported by a bracket 67, which in turn, is mounted on duct 38. Adjacent on one end of the check valve shaft 56, for each of the check valves, is mounted a position sensor 72. The position sensor 72 includes a light source 74 which is conveyed through a pair of fiber optics 76 to a position adjacent to segment 64. The pair of fiber optics 76 are mounted so as to line up with the holes 70 and 71. When the check valve is properly closed, hole 71 will be in a position so that light from one of the fiber optics penetrates the hole 71 and is detected by a sensor 78 which is also mated with, and lined up with, hole 71. When the check valve is open, hole 70 will line up with the other of the fiber optic pair and light from that source will penetrate opening 70 and will be picked up by one of the pair of sensors 78. In either case, the light will be transmitted by a pair of fiber optics to a light sensor 80. Each sensor 80 is connected to its own computer input port. Therefore, the computer will be advised in each instance whether the valve is open or closed or at some position in between. For example, if the check valve is neither open nor closed, the light from fiber optics 76 will not penetrate hole 70 or 71. The absense of such light will inform the computer 81 that the valve is not in the proper position.

Figure 6:
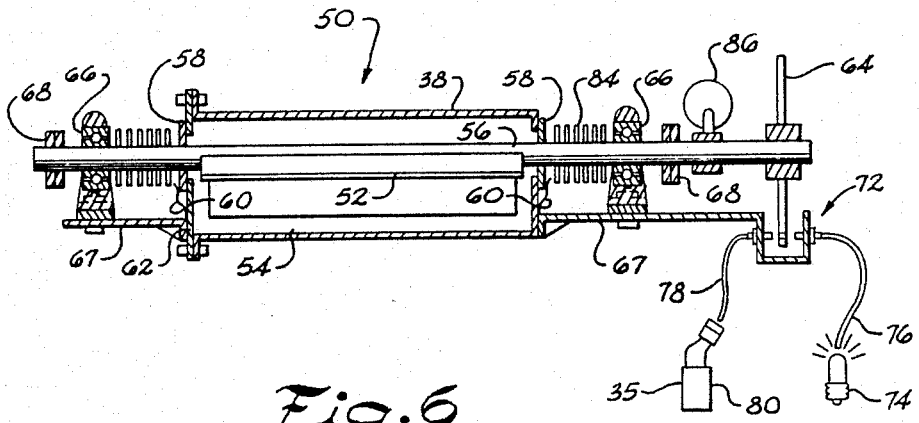
FIG. 6 is a side elevational, cut-away view of another embodiment of the manifold check valve similar to that shown in FIGS. 5 and 5A.

FIG. 6 illustrates an alternative form of the check valve 50 and similar parts to those of check valve 50 shown in FIGS. 5 and 5A are identified by like reference characters in FIG. 6. The major difference between the check valve of FIGS. 5 and 5A and that of FIG. 6 is the provision of a series of cooling fins 84 located on shaft 56 at each end thereof, between the asbestos seal 58 and the bearings 66. In installations where space permits, the use of the cooling fins assist in dissipating the heat from check valve shaft 56. Also provided on shaft 56 is a counter weight 86 to balance the weight of check plate 52. In this embodiment, segment 64 is located at the end of the shaft 56 and position sensor 72 is supported adjacent to the segment, of course.

Referring now to FIG. 7 it will be seen that shaft 56 is driven by a motor 82. Motor 82 can rotate shaft 56 in either direction as required to either open or close the check valve. In this Figure, computer signal preparation is illustrated diagrammatically showing how information concerning the position of the check valve is obtained and conveyed to the computer controlling the safe operation of the fume incinerator apparatus.

The cycling of the regeneration are controlled by a known computer such as the 8052, but any general purpose computer can be programmed to control the regenerators and to operate the incinerator in the manner described above.

In the preferred operating sequence, generators 30, 28, and 26 all cycle as follows. First, waste gases flow through regenerators 30 and 28, and exhaust gases flow through 26. Second, waste gases flow through regenerator 28 and exhaust gases flow through regenerators 30 and 26. Third, waste gases flow through 28 and 26, and exhaust gases flow through regenerator 30. Fourth, waste gases flow through 26, and exhaust gases flow through 30 and 28. Fifth, waste gases flow through regenerators 30 and 26 and exhaust gases flow through regenerator 28. Sixth, waste gases flow through regenerator 30, and exhaust gases flow through regenerators 28 and 26. The cycle is then repeated.

As noted above for saftey purposes, it is necessary to check on the position of the check valves every couple of seconds. It is also necessary to check on the position of valves 41 and 43 in lines 40 and 42. It should be noted that valves 37 and 41 open and close together and that valves 39 and 43 open and close together. Therefore, the sensed signals from these valves can be combined with electric logic "AND" GATES so that, for example, with three regenerators it is only necessary to sense twelve rather than twenty-four valve position signals for input to an electronic program controller or computer.

The basic control cycle is programmed into the EPRO chip of an 8052 computer controller. The 8052 computer will time and control the operation of the actuated valves of the three regenerator beds, will sense the twelve valve positions four to five times per second, will indicate by lights to the operator if any valves are not in their full open or full closed position, and will turn off fuel to the incinerator burner if any valve fails to attain its correct positions for longer than two seconds. The computer will also reset an external one second timer that will automatically turn off fuel to the burner if this timer has not been reset within one second. The 8052 computer has sixteen parallel inputs, twelve of which are used to input valve positions, and eight parallel outputs, six of which are used to close the six actuated valves, the seventh output is used to reset the fuel-off timer in case of failure of the computer control system and the eighth output is used to turn off fuel if any valves are not in their proper position for longer than two seconds.

Hereinabove, an embodiment of the invention has been described which utilized three regeneration beds. However, it is to be understood that as many regeneration beds as desired can be used, but at least three beds must be used in order to operate the incinerator safely. This permits the use of two beds at one time in operation, that is one bed through which the incoming waste gases are preheated en route to the burner and a second regenerator in which the heat exchange bed is heated by the passage of purified gases from the incinerator en route to the exhaust system. The third regenerator remains idle for three quarters to one ($\frac{3}{4}$ to 1) second out of thirty (30) seconds until its turn and is then cycled to receive the next heated exhaust gases prior to being utilized to preheat the incoming waste fumes. Where more than three regenerators are utilized the cycle may be varied to suit the demands of the installation, but in any event, the waste fumes must always be fed behind the burner and through the flame of the burner for ignition after having been preheated by passage through a hot regenerator bed.

It is to be understood that other modifications of the apparatus shown and described herein which do not depart from the essence of this invention may occur to one skilled in the art. Therefore, it is to be understood that the description of the invention herein is only by way of example and not by way of limitation and that the invention herein is limited solely by the claims which follow.

What is claimed is:

1. A continuous flow thermal regeneration incinerator comprising:

(a) a combustion chamber having an opening in an entrance end of said chamber and having an exit end;

(b) a plenum chamber disposed adjacent said entrance end of said combustion chamber in fluid communication with said combustion chamber;

(c) a combustion burner disposed within said plenum chamber so that the flame from said burner extends generally adjacent said entrance end opening of said combustion chamber and waste fumes flow from said plenum through said entrance end for combustion by the flame;

(d) at least three separate regeneration heat exchanger beds, disposed adjacent to said plenum chamber and said combustion chamber;

(e) inlet manifold means connecting each of said regenerative heat exchanger beds to said plenum chamber;

(f) a supply duct for supplying waste fumes to said regenerative heat exchanger beds, selectively;

(g) a inlet duct connecting each of said regenerative heat exchanger beds to said supply duct;

(h) an exhaust manifold communicating with said combustion chamber for carrying away purified gases having a negative pressure therein for selectively exhausting the purified gases through said regenerative heat exchanger beds;

(i) an exhaust duct connecting each of said regenerative heat exchanger beds to said exhaust manifold;

(j) an exhaust line connecting each of said regenerative heat exchanger beds to an ambient atomsphere;

(k) valve means for selectively connecting said regenerative heat exchanger beds to said supply duct and to said inlet manifold for supplying waste fumes to said burner;

(l) valve means for selectively connecting said regenerative heat exchanger beds to said exhaust manifold and to said exhaust line for sending purified gases to the ambient atmosphere; and (m) control means for cycling said valve means for alternately connecting said heat regenerative exchanger beds to said supply duct and to said exhaust manifold in a manner that flow direction in said regeneration heat exchanger beds reverses but flow direction in said combustion chamber continuously flows in one direction from said plenum chamber, through said entrance end, and out of said exit end of said combustion chamber.

2. The thermal regeneration incinerator as set forth in claim 1, wherein said regenerative heat exchanger beds preheat the waste fumes prior to introduction of the waste fumes to the flame of said burner.

3. The thermal regeneration incinerator as set forth in claim 1, wherein each of said regenerative heat exchanger beds comprise ceramic elements.

4. The thermal regeneration incinerator as set forth in claim 1, wherein each of said regenerative heat exchangers comprise a bed of metalic elements.

5. A continuous flow thermal regeneration waste gas incinerator, comprising:

(a) a combustion chamber having an entrance opening for waste gases and an outlet opening for processed gases;

(b) a plenum chamber surrounding the entrance opening of said combustion chamber in fluid communication with said combustion chamber;

(c) a combustion burner disposed within said plenum chamber adjacent said entrance opening in said combustion chamber so that its flame extends into said combustion chamber;

(d) at least first, second, and third regenerators disposed adjacent to said combustion chamber, and duct means for connecting each of said regenerators first, second and third into fluid communication with said plenum chamber and to said outlet opening of said combustion chamber;

(e) valve means in said duct means for selectively connecting each of said first second and third regenerators to a supply of waste gases and to said plenum chamber and alternately to said outlet opening and to a central exhaust for exhausting to an ambient atmosphere; and (f) control means for controlling said valve means to selectively connect said first regenerator to said outlet opening and the central exhaust for delivering heated gases from said combustion chamber to said ambient atmosphere, to connect said second regenerator to the supply of waste gases and to said plenum chamber for supplying preheated waste gas adjacent said burner for combustion by said flame, and to disconnect said third regenerator from said waste gas supply and said central exhaust in a cyclic manner.

6. The thermal regenerative waste gas incinerator as set forth in claim 5, wherein each of said first, second, and third regenerators are at least partially filled with a plurality of ceramic heat exchange elements which absorb heat from the hot processed gases and which transfer absorbed heat to waste gases, preparatory to their transport to said plenum chamber.

7. The thermal regeneration waste gas incinerator as set forth in claim 5 wherein said valve means comprises a valve pivoted between open and closed positions on a shaft.

8. The thermal regeneration waste gas incinerator as set forth in claim 5, wherein said control means comprises a computer which checks the position of each of the valve means at least once each second.

9. The thermal regeneration waste gas incinerator as set forth in claim 5 wherein said control means comprises a computer for periodically sensing the position of said valve means and for operating said valve means to open and to close said valve means at predetermined times during the operation of the incinerator.

10. The thermal regeneration waste gas incinerator as set forth in claim 9, wherein said computer turns off the fuel supply to said burner whenever any valve within the incinerator fails to attain its proper position for a period of about two seconds or more.

11. The thermal regenerator waste gas incinerator as set forth in claim 5, wherein said control means includes means for determining whether said valve means are open or closed during the operation of said regenerators.

12. The thermal regeneration waste gas incinerator as set forth in claim 11, wherein said control means comprises a segment connected to said valve means and position sensing means for detecting the position of said segment to determine whether said valve is open or closed.

13. The thermal regeneration waste gas incinerator as set forth in claim 12, wherein said segment is provided with fins for assisting the dissipation of heat from said valve means.

* * * * *